US009605483B2

(12) United States Patent
Jerez et al.

(10) Patent No.: US 9,605,483 B2
(45) Date of Patent: Mar. 28, 2017

(54) DIRECTIONAL DRILLING WHILE CONVEYING A LINING MEMBER, WITH LATCHING PARKING CAPABILITIES FOR MULTIPLE TRIPS

(71) Applicant: Halliburton Energy Services, Inc., Houston, TX (US)

(72) Inventors: Hernando Jerez, The Woodlands, TX (US); Richard T. Hay, Spring, TX (US); John G. Evans, The Woodlands, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/029,492

(22) PCT Filed: Oct. 26, 2015

(86) PCT No.: PCT/US2015/057385

§ 371 (c)(1),
(2) Date: Apr. 14, 2016

(87) PCT Pub. No.: WO2016/073236

PCT Pub. Date: May 12, 2016

(65) Prior Publication Data

US 2016/0326807 A1 Nov. 10, 2016

Related U.S. Application Data

(60) Provisional application No. 62/074,460, filed on Nov. 3, 2014.

(51) Int. Cl.
*E21B 23/02* (2006.01)
*E21B 7/20* (2006.01)
(Continued)

(52) U.S. Cl.
CPC ..... *E21B 7/208* (2013.01); *E21B 4/00* (2013.01); *E21B 7/04* (2013.01); *E21B 7/06* (2013.01);
(Continued)

(58) Field of Classification Search
CPC combination set(s) only.
See application file for complete search history.

(56) References Cited

U.S. PATENT DOCUMENTS 5,197,553 A 3/1993 Leturno
5,271,472 A 12/1993 Leturno
(Continued)

FOREIGN PATENT DOCUMENTS

WO WO-2014137914 A1 9/2014

OTHER PUBLICATIONS

International Search Report and Written Opinion, Feb. 1, 2016, 13 pages, Korean Intellectual Property Office.

*Primary Examiner* — David Andrews
*Assistant Examiner* — Ronald Runyan

(57) ABSTRACT

A method and system for directional drilling while conveying a liner, with latching parking capabilities for multiple trips, is disclosed. As the wellbore is drilled, each casing and liner is installed having upper and lower interior latch couplings. A liner to be installed below a parent casing includes an exterior latch assembly dimensioned for connection to the interior latch couplings of the parent casing. A bottom hole assembly may include upper and lower exterior inner string latch assemblies for connection to the upper and lower interior latch couplings of the liner to be installed. Such arrangement allows the liner to be conveyed and installed with the bottom hole assembly while directional drilling and for the liner to be temporarily hung from the parent casing for bottom hole assembly change-out while
(Continued)

drilling. Float plugs dimensioned to be landed at lower liner interior latch couplings may be provided for cementing operations.

19 Claims, 15 Drawing Sheets

(51) Int. Cl.

| | |
|---|---|
| ***E21B 7/04*** | (2006.01) |
| ***E21B 4/00*** | (2006.01) |
| ***E21B 7/06*** | (2006.01) |
| ***E21B 7/28*** | (2006.01) |
| ***E21B 10/26*** | (2006.01) |
| ***E21B 10/64*** | (2006.01) |
| ***E21B 17/07*** | (2006.01) |
| ***E21B 23/01*** | (2006.01) |
| ***E21B 23/04*** | (2006.01) |
| ***E21B 33/16*** | (2006.01) |
| ***E21B 37/00*** | (2006.01) |
| ***E21B 43/08*** | (2006.01) |
| ***E21B 43/10*** | (2006.01) |
| ***E21B 47/01*** | (2012.01) |
| *E21B 4/02* | (2006.01) |
| *E21B 10/02* | (2006.01) |
| *E21B 10/60* | (2006.01) |
| *E21B 47/18* | (2012.01) |
| *E21B 23/00* | (2006.01) |

(52) U.S. Cl.

CPC ..... *E21B 7/20* (2013.01); *E21B 7/28* (2013.01); *E21B 10/26* (2013.01); *E21B 10/64* (2013.01); *E21B 17/07* (2013.01); *E21B 23/01* (2013.01); *E21B 23/04* (2013.01); *E21B 33/16* (2013.01); *E21B 37/00* (2013.01); *E21B 43/08* (2013.01); *E21B 43/105* (2013.01); *E21B 43/106* (2013.01); *E21B 47/011* (2013.01); *E21B 4/02* (2013.01); *E21B 10/02* (2013.01); *E21B 10/60* (2013.01); *E21B 47/18* (2013.01); *E21B 2023/008* (2013.01)

(56) References Cited

U.S. PATENT DOCUMENTS

| | | | | |
|---|---|---|---|---|
| 7,784,552 | B2 | 8/2010 | Brouse | |
| 7,861,781 | B2 | 1/2011 | D'Arcy | |
| 2005/0274547 | A1 | 12/2005 | Fincher et al. | |
| 2007/0267221 | A1 | 11/2007 | Giroux et al. | |
| 2008/0257561 | A1 | 10/2008 | Fay et al. | |
| 2009/0107675 | A1* | 4/2009 | Eriksen | E21B 7/20 166/285 |
| 2012/0145463 | A1 | 6/2012 | Lee et al. | |
| 2012/0168178 | A1 | 7/2012 | Eriksen et al. | |
| 2014/0041881 | A1* | 2/2014 | Dirksen | E21B 23/00 166/382 |

* cited by examiner

DIRECTIONAL DRILLING WHILE CONVEYING A LINING MEMBER, WITH LATCHING PARKING CAPABILITIES FOR MULTIPLE TRIPS

PRIORITY

The present application is a U.S. National Stage patent application of International Application No. PCT/US2015/057385, filed on Oct. 26, 2015, which claims priority to U.S. Provisional Patent Application No. 62/074,460, entitled, "METHOD FOR DIRECTIONAL DRILLING WHILE CONVEYING A LINER, WITH LATCHING PARKING CAPABILITIES FOR MULTIPLE TRIPS," filed Nov. 3, 2014, the disclosures of which are hereby incorporated by reference in their entirety.

TECHNICAL FIELD

The present disclosure relates generally to oilfield equipment, and in particular to downhole tools, drilling and related systems and techniques for directional drilling and completing wellbores in the earth.

BACKGROUND

From a well construction point of view, the production of oil encounters increased challenges due to formation pressure depletion. Small reservoir pockets may require complex well trajectories with concomitant challenges. Events such as hole instability, loss circulation zones, salt creeping, stuck pipe, etc. may create nonproductive time in the drilling process, and worse, may possibly deny access to intended hydrocarbon reserves entirely. In addition, field development plans may involve more complex well trajectories with narrow mud windows in unstable formations, which may benefit from a different drilling approach to reduce unscheduled events.

BRIEF DESCRIPTION OF THE DRAWINGS

Embodiments are described in detail hereinafter with reference to the accompanying Figures, in which.

DETAILED DESCRIPTION

Figure 1:
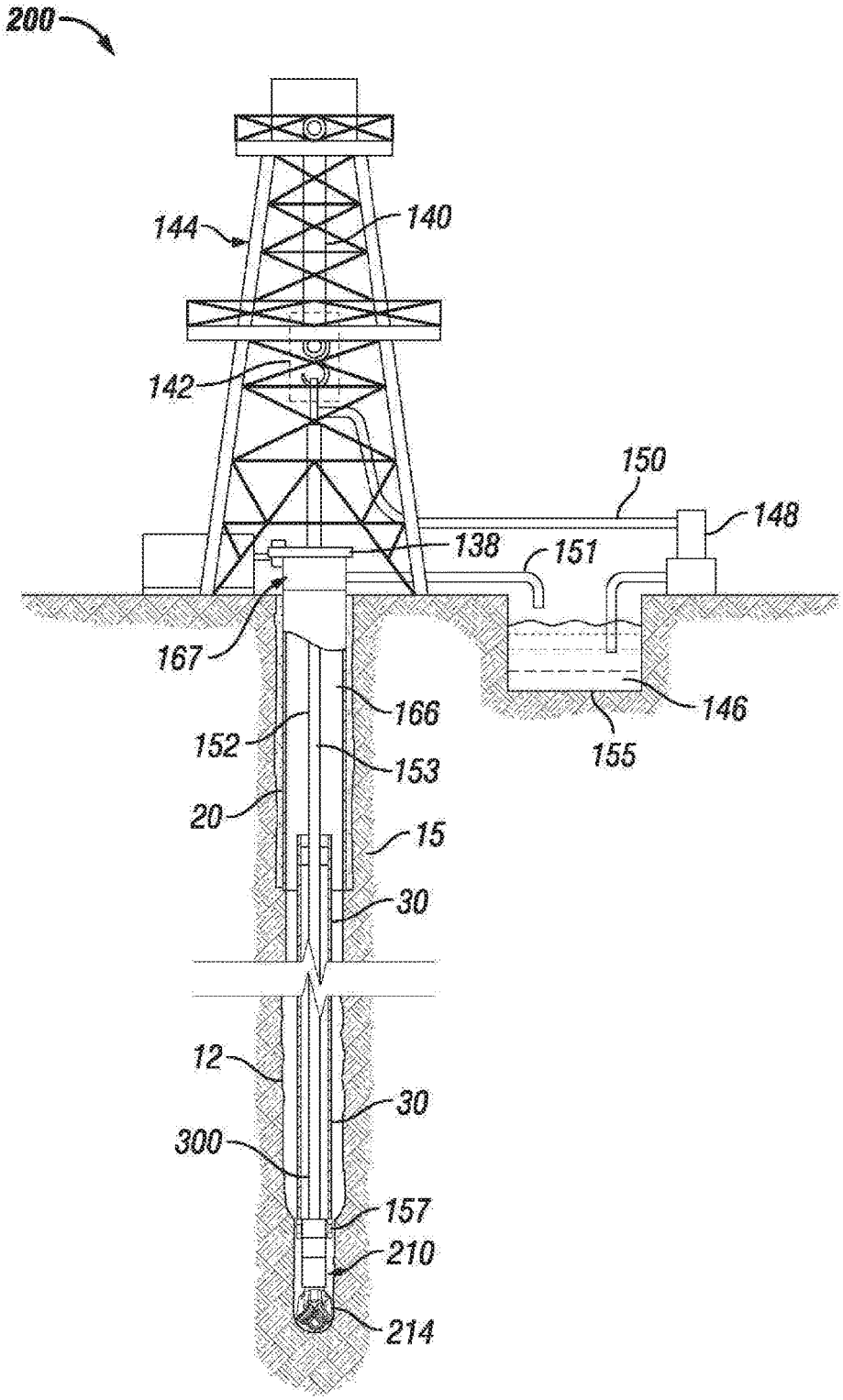
FIG. 1 is an elevation view in partial cross section of a system for directional drilling while conveying a lining member according to an embodiment.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the Figures. The spatially relative terms are intended to encompass different orientations of the apparatus in use or operation in addition to the orientation depicted in the figures.

FIG. 1 is an elevation view in partial cross-section of a liner while drilling system 200 according to one or more embodiments. A directional drilling while lining system 200, as disclosed herein, may allow directional drilling of a wellbore while simultaneously conveying a lining member 30. The capabilities of directional drilling system may include, but are not limited to the following: The capability to complete multiple bottom hole assembly trips (for bit or bottom hole assembly replacement, for example); the ability to enlarge the pilot hole; ability for temporary liner hanging; the capability to case the complete open hole; the capability for steering while drilling and rotating; retrievability by a bottom hole assembly; and the ability to perform conventional cementation operations.

As described in greater detail hereinafter, in one or more embodiments, liner while directional drilling system 200 may be capable of both offshore and onshore use to enable accurate wellbore placement where adverse hole conditions may require casing or liners to be in place. System 200 may be capable of multiple operations of selective latching and unlatching a lining member 30 to casing 20 while handling the weight of the liner and bottom hole assembly and string, withstanding drilling torque requirements, allowing for use in long lateral sections, providing sealing at the top of the liner to the annulus, preserving liner inner diameter, tolerating debris, handling rotation for long periods, providing for fishing operations, and maintaining compatibility with tools and systems presently available. Liner while directional drilling system 200 may also be capable of conveying and employing float equipment for cementing, including plugs to be activated by dropping balls, bottom plugs to incorporate back pressure valves, and a displacement plug to be latched on top of a bottom plug. Further, liner while directional drilling system 200 may be drillable.

Moreover, in one or more embodiments, liner while directional drilling system 200 may include a bottom hole assembly (BHA) 210, which may include two reamers to allow total depth reaming of a pilot hole. Such reamers may be wired to a controller in communication with an operator via a downlink telemetry system, for example, by using a surface mud pulser, variation in mud pump operation, rotation of a tubular conveyance, dropping a ball or dart in the mud flow, or activation using a signaling device, such as an radio frequency identification (RFID) device, placed in the mud flow. Such reamers may also be hydraulically activated/deactivated by use of the mud pumps. BHA 210 may include a wired downhole motor 224. Each reamer may be independently actuated or selectively ganged to actuate in unison or in opposite action to each other; for example one reamer may extend its reamer blades while the other reamer may retract its reamer blades.

System 200 may be located on land, as illustrated, or atop an offshore platform, semi-submersible, drill ship, or any other platform capable of forming wellbore 12 through one or more downhole formations 15. System 200 may be used in vertical wells, non-vertical or deviated wells, multilateral wells, offshore wells, etc. Wellbore 12 may include casing 20 and may include one or more open hole portions.

System 200 may include a drilling rig 144. Drilling rig 144 may be located generally above a well head 167, which in the case of an offshore location is located at the sea bed and may be connected to drilling rig 144 via a riser (not illustrated). Drilling rig 144 may include a top drive 142, rotary table 138, hoist assembly 140 and other equipment associated with raising, lowering, and rotating a drill string 152 within wellbore 12. Blow out preventers (not expressly shown) and other equipment associated with drilling a wellbore 12 may also be provided at well head 167.

A drill string 152 may be assembled from individual lengths of casing, drill pipe, coiled tubing, or other tubular goods. In one or more embodiments, drill string 152 has a hollow interior 153. An annulus 166 is formed between the exterior of drill string 152 and the inside diameter of wellbore 12. The downhole end of drill string 152 may carry a BHA 210. A distal bit 214 may be a conventional drill bit, reamer, coring bit, or other suitable tool. BHA 210 may include a motor 224, operable to rotate distal bit 214. Motor 224 may be a mud motor. However, an electric motor, powered by a hydraulically-powered electrical generator or electrical connection to the surface, for example, may be used in lieu of a mud motor. In place of a mud motor, a turbodrill vane-type motor or any other type of motoring device may also be used to apply drilling torque to the distal bit 214. A tractor assembly or anchoring device 157 may be provided within BHA 210 for counteracting any tendency of BHA 210 to rotate within wellbore 12 during rotation of distal bit 214. BHA 210 may also include various subs, centralizers, drill collars, logging tools, or similar equipment. Drill string 152 may carry lining member 30, as described in detail hereinafter.

Various types of drilling fluids 146 may be pumped from pit 155 through pump 148 and conduit 150 to the upper end of drill string 152 extending from well head 167. The drilling fluid 146 may then flow through longitudinal bore 153 of drill string 152 and exit through nozzles (not illustrated) formed in distal bit 214 or at least a portion of the fluid elsewhere in BHA 210 or drill string 152. Drilling fluid 146 may mix with formation cuttings and other downhole fluids and debris proximate drill bit 214. Drilling fluid 146 will then flow upwardly through annulus 166 to return formation cuttings and other downhole debris to well head 167. Conduit 151 may return the drilling fluid to pit 155. Various types of screens, filters and/or centrifuges (not expressly shown) may be provided to remove formation cuttings and other downhole debris prior to returning drilling fluid to pit 155. Drilling fluid 146 may also provide a communications channel between BHA 210 and the surface of wellbore 12, via mud pulse telemetry techniques, for example.

Figure 2:
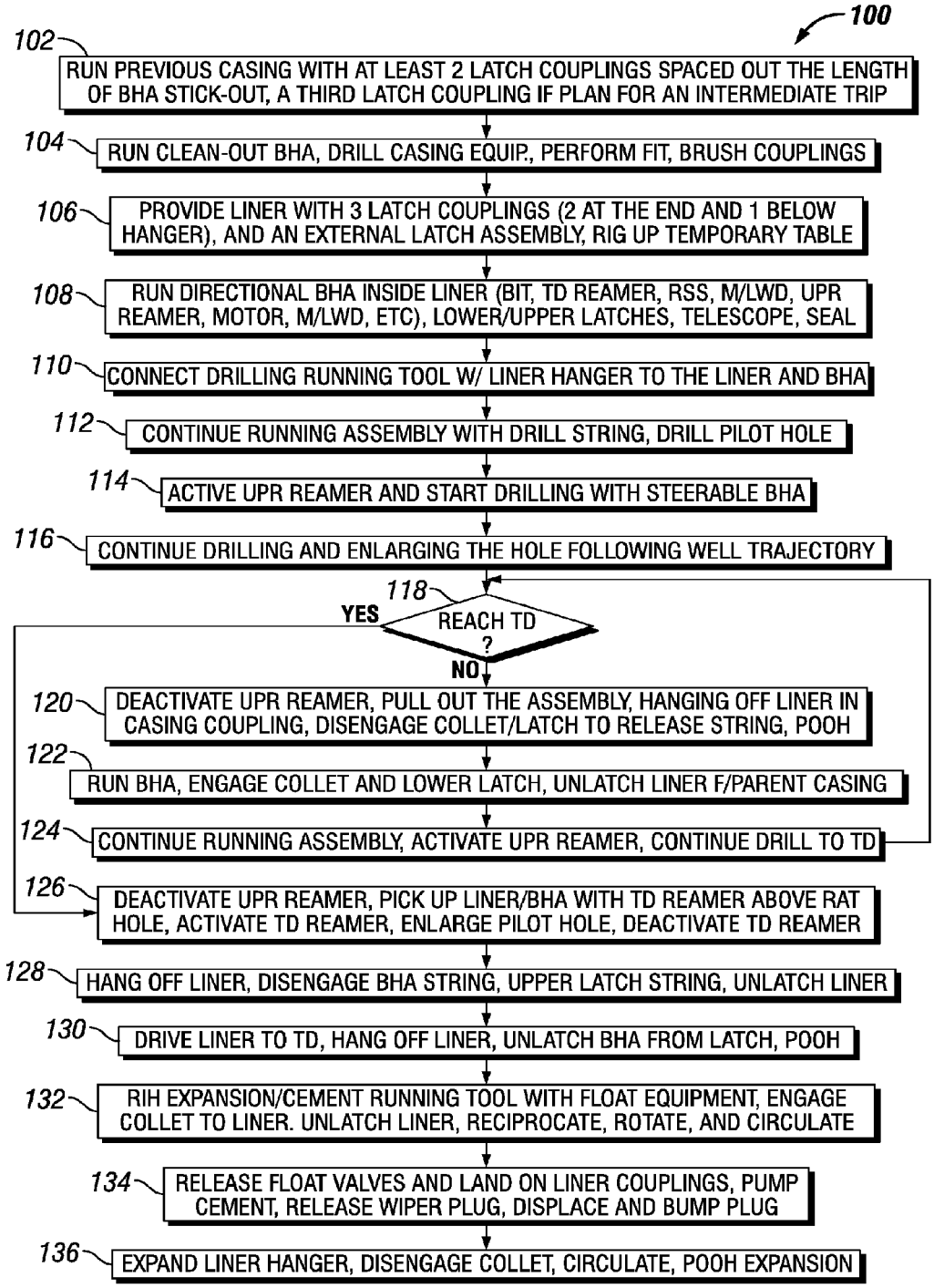
FIG. 2 is a flow chart of a method for directional drilling while conveying a lining member according to an embodiment.

FIG. 2 is a flow chart of a method 100 for directional drilling while conveying a liner according to an embodiment. Method 100 may provide to ability to steer a wellbore to a predefined direction while conveying a liner for casing the newly drilled open hole interval using liner while directional drilling system 200. Directional drilling system 200 may include a steerable BHA 210 and a vast array of drilling components.

Figure 3:
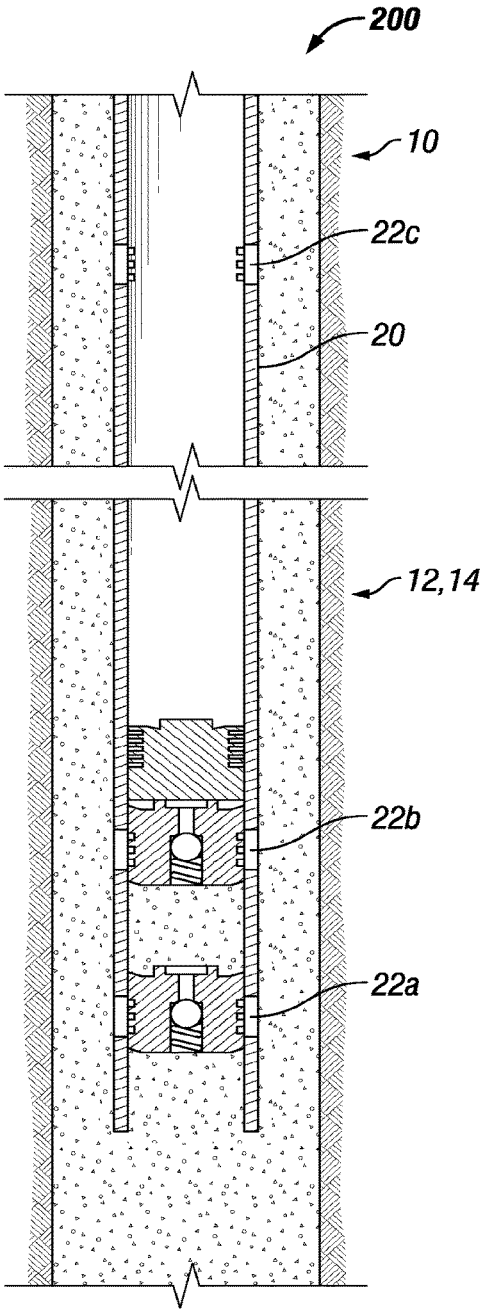
FIGS. 3 and 4 are axial cross sections of an upper portion of well for use with the directional drilling while conveying a lining member method of FIG. 2, illustrating hole preparation operations and casing installed with interior casing latch couplings.

FIG. 3 is a an axial cross section of a well 10 with liner while directional drilling system 200 according to hole preparation step 102 of FIG. 2. Referring to FIGS. 2 and 3, an upper portion 14 of a wellbore 12 may be drilled. According to one or more embodiments, the directional lining/drilling process requires advanced planning, as the previous or parent casing or liner member 20 (hereinafter, simply, parent casing) incorporates internal casing latch couplings 22 that allow for hanging a directional drilling system-conveyed lining member 30 (FIG. 5) for the next downhole section during bottom hole assembly changes or once at total depth. Latch couplings 22 may allow for temporarily parking lining member 30 for the bottom hole assembly changes or when switching to cementing operations.

Accordingly, at various depths, internal casing latch couplings 22 may be installed in the previous or parent casing 20, depending upon the length and formation drillability of the planned interval. Two or more internal casing latch couplings 22*a*, 22*b* may be installed on parent casing 20, one near the bottom end of parent casing 20 and the other spaced uphole at least the length of the pilot bottom hole assembly. A third casing latch coupling 22*c* may be provided for an intermediate drill bit or bottom hole assembly change. Additional casing latch couplings 22 may also be provided and spaced along parent casing 20. Once parent casing 20 has been run into wellbore 12, parent casing 20 may be conventionally cemented.

Figure 4:
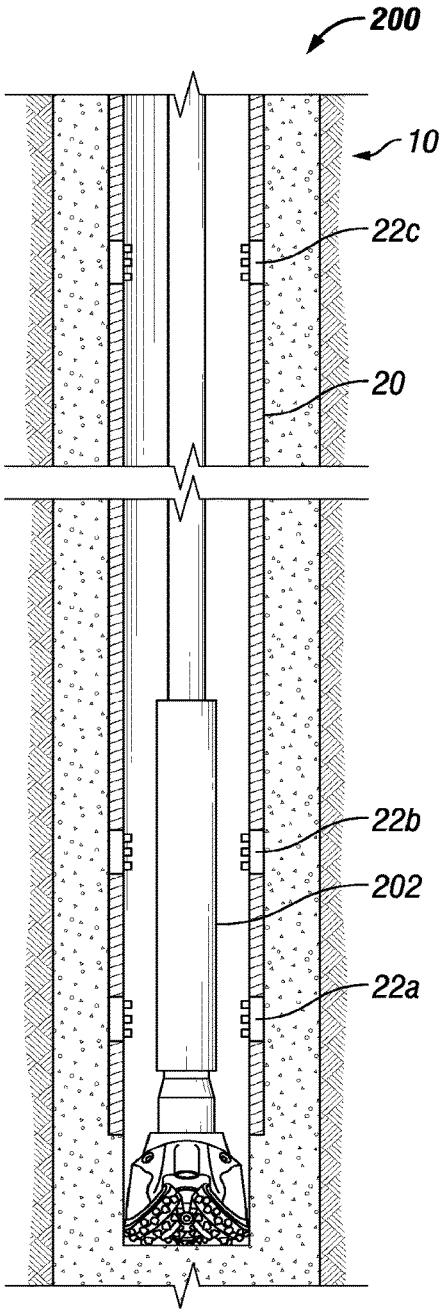

FIG. 4 is a an axial cross section of well 10 with liner while directional drilling system 200 according to hole preparation step 104 of FIG. 2. Referring to FIGS. 2 and 4, after cementing parent casing 20, a clean-out bottom hole assembly 202 may be run in order to drill out casing equipment such as the float valves and wiper plug, perform leak off testing (if required), and optionally brush or otherwise clean internal latch couplings 22 in preparation for liner hanging, if deemed necessary. After the clean-out run, clean-out bottom hole assembly 202 may be pulled out of hole.

Figure 5:
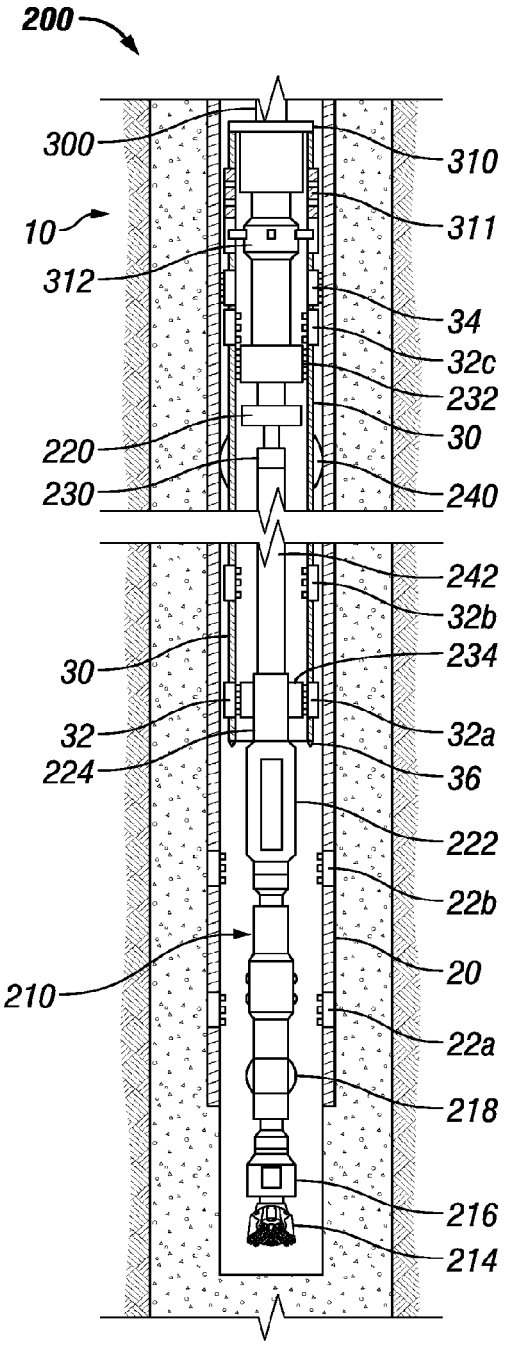
FIG. 5 is a an axial cross section of the well of FIG. 4 with a lining member while directional drilling system according to an embodiment, illustrating initial liner running operations according to the method of FIG. 2.

FIG. 5 is a an axial cross section of well 10 with liner while directional drilling system 200 according to liner running steps 106, 108, 110 of FIG. 2. Referring to FIGS. 2 and 5, after hole preparation, the directional drilling system-conveyed lining member 30 may be run, as follows:

At step 106, lining member 30 may be provided. Lining member 30 may include an external liner latch assembly 34 to allow hanging lining member 30 from latch couplings 22 in parent casing 20. External liner latch assembly 34 may complement and allow selective engagement and disengagement with internal casing latch couplings 22 of parent casing 20. External liner latch assembly 34 may include a housing with multiple latch segments that properly align with and engage slots of predetermined dimensions and orientations in internal casing latch couplings 22. In one or more embodiments, latch coupling pairs 22, 34 may employ Halliburton Multilateral Latch System components, which may be installed in the same manner as a standard casing coupler yet provide an anchoring mechanism for accurate and repeatable placement and orientation of equipment. Latch coupling components 22, 34 may be permanently installed in casing 20 and lining member 30, respectively, satisfying burst and collapse pressure requirements while optionally not restricting the inner diameter of the respective string.

In one or more embodiments, the mating latch profile arrangement, such as slots, internal ledges, or internal upsets, may be integrated into the internal portion of the casing or liner tubing itself by direct modification of the liner or casing for the desired anchoring capability of an inner member of the lining that is positioned to latch into the mating latch profile arrangement on the inside of casing or lining member 20. Further it is noted that the latch or mating slot arrangements, for example, can be switched to be either on the lining member or on the inner drill string.

The lower end of lining member 30 may include a liner shoe 36 that enables conveyance of lining member 30. In particular, as with parent casing 20, liner internal liner latch couplings 32 may be provided, with two liner latch couplings 32*a*, 32*b* located close to the bottom end of lining member 30 and one liner latch coupling 32*c* located further uphole, positioned to be below a liner hanger 310, as discussed in greater detail hereinafter. The lower two liner latch couplings 32*a*, 32*b* may accept liner float equipment and plugs for subsequent operations. As with internal casing latch couplings 22, internal liner latch couplings 32 may employ Halliburton Multilateral Latch System components.

At step 108, a directional drilling BHA 210 may be run through lining member 30. In one or more embodiments, directional drilling BHA 210 may include a drill bit 214, a total depth or lower reamer 216, a rotary steerable system (RSS) 218, a measurement while drilling sub 220, an upper reamer 222, and a motor 224. Steering system 218 may incorporate steerable capabilities to follow a desired trajectory. Measurement while drilling sub 220 may include a gyro-while-drilling and a telemetry module. The portion of directional drilling BHA 210 that extends beyond the lower end of lining member 30 may be minimized by using a wired upper reamer 222 and a wired motor 224 and by locating motor 224, and at least the telemetry portion of measurement while drilling (MWD) sub 220 within lining member 30 but with the output shaft of the mud motor located below the lower latch 32*a* so as to provide drilling torque to the reamers and drill bit. The wiring of the reamer and the mud motor facilitates communication between the portion of the MWD that may remain inside the lining member 30 and the portion of the BHA 210 that must remain below the upper reamer 222 for functional purposes. Such BHA sub systems can include bore hole survey systems, logging while drilling (LWD) systems and portions of the steering assembly that require commands to control such as an actuator in a rotary steerable system.

The position of a borehole survey system that is within the MWD system 220 may be determined based on the kind of direction sensor it has and whether or not the material in the vicinity of the survey system is magnetizable, such as in the case of ferrous materials like iron and chromium alloys which are common to casing materials. Ferrous materials for example may interfere with a magnetic survey instrument that is used to measure the earth's magnetic field. Thus, such a system may be required to be placed below a ferrous lining member, or at least the portion of lining member. Additionally, other nearby members where the sensor is placed in the lining member would have to be made of a non-magnetic material, such as an austenitic stainless steel, monel, or composite material. As this is an expensive arrangement, a gyroscope may instead be employed in MWD 220, which is immune to the effects of magnetizable material in its vicinity and thereby allows the survey portion of the system to be located within the lining member 30.

Drilling torque with rotation may also be provided from surface by the drilling rig to assist or in place of the down hole drilling motor in the BHA 210 by rotating the drill string from surface.

Total depth reamer 216 may be located just above drill bit 214 to enlarge the pilot hole at the time the total depth is reached. Conventional reaming technology may involve multiple trips to enlarge the wellbore. Combined with the traditional challenges of downhole steerability, creating an enlarged borehole at total depth may leave the operator with an overlong rat hole. However, total depth reamer 216 may eliminate the long rat hole with minimal effect on steerability. Total depth reamer 216 may be a short, integrated reaming tool placed between drill bit 214 and rotary steerable system 218, thus enabling rat hole reduction to as little as three feet and optimizing borehole size at total depth. Elimination of the long rat hole using total depth reamer 216 may provide an important benefit, as some well plans may require setting lining member 30 at a specific pressure change point. In one or more embodiments, total depth reamer 216 may be a Halliburton TDReam™ Tool.

In one or more embodiments, upper reamer 222 may be a hole enlargement tool engineered to minimize lateral vibrations in simultaneous operations. Excess lateral vibration while simultaneously drilling and reaming may result in a life reduction of rotary steerable system 218. Upper reamer 222 may include a self-stabilizing body and articulated deployment to minimize whirling and side loads transmitted through BHA 210 during transition drilling operations. Upper reamer 222 may also provide for reamer deactivation. When finished enlarging the hole, the arms/cutting structure of upper reamer 222 may be closed and drilling resumed, or upper reamer 222 may be pulled while simultaneously circulating at full flow rate and rotating. In one or more embodiments, upper reamer 222 may be a Halliburton XR™ reamer tool.

Directional drilling BHA 210 may also include a telescoping joint 230 and upper and lower external inner string latch assemblies 232, 234 for coupling to lining member 30. Upper external latch assembly 232 may be located at or near the top of the directional drilling BHA 210 to accomplish hanging the string inside lining member 30. Upper external latch assembly 232 may also provide stabilization along the string inside lining member 30. Lower external latch assembly 234 may anchor and transmit torque to lining member 30. The exterior surface of lining member 30 may also include an array of centralizers 240. Finally, directional drilling BHA 210 may include drill pipe 242, which may include heavy wall drill pipe, and other components, such as a jar (not illustrated).

At step 110, a drilling running tool 300 may be connected to directional drilling BHA 210 using liner hanger 310. Telescopic joint 230 may be longitudinally extended to accommodate connection of directional drilling BHA 210 to drilling running tool 300. Additionally, in one or more embodiments, telescopic joint 230 may be extended by pressurizing the inner string with fluid in order to latch/anchor lower external latch assembly 234 with a liner latch coupling 32.

Liner hanger 310 may be a flexible liner hanging system, which may include an integral tieback receptacle and expandable solid hanger body 311 that is bonded to multiple elastomeric elements, and which may provide both a bi-directional annular seal and tensile and compressive load transfer capabilities. A collet assembly 312 may be connected between directional drilling BHA 210 and hanger body 311 to transfer linear forces and torque between liner hanger 310 and directional drilling BHA 210. In an embodiment, liner hanger 310 may be a Halliburton VersaFlex® liner hanger system.

Figure 6:
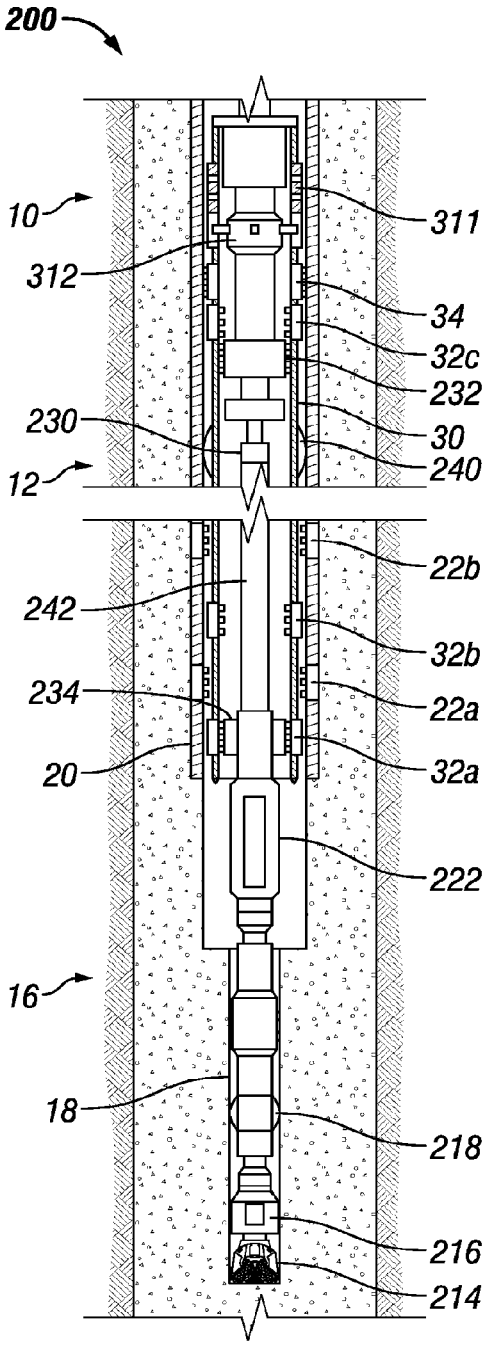
FIGS. 6 and 7 are axial cross sections of the well and liner while directional drilling system of FIG. 5, illustrating directional drilling operations while conveying a lining member according to the method of FIG. 2.
Figure 7:
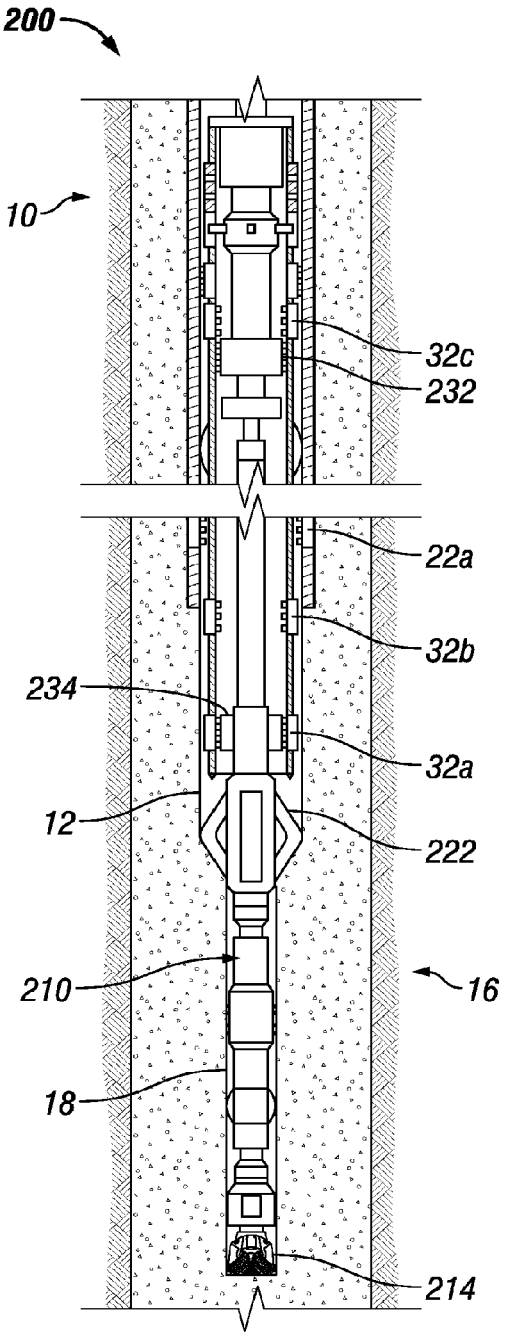

FIGS. 6 and 7 are axial cross sections of well 10 with liner while directional drilling system 200 according to well drilling steps 112-116 of FIG. 2, in which a lower portion 16 of wellbore 12 may be drilled. Referring to FIGS. 2 and 6, at step 112, the drilling of a pilot or rat hole 18 may be performed until upper reamer 222 is located below the bottom end of parent casing 20. Collet assembly 312 may carry the weight of directional drilling BHA 210 with lining member 30 as well as transmit torque to lining member 30.

Referring to FIGS. 2 and 7, at step 114, upper reamer 222 may be activated, and directional drilling to total depth, or any intermediate depth, may be continued according to step 116, with drill bit 214 drilling pilot hole 18 and upper reamer 222 concurrently enlarging the pilot hole to a desired gauge.

Figure 8:
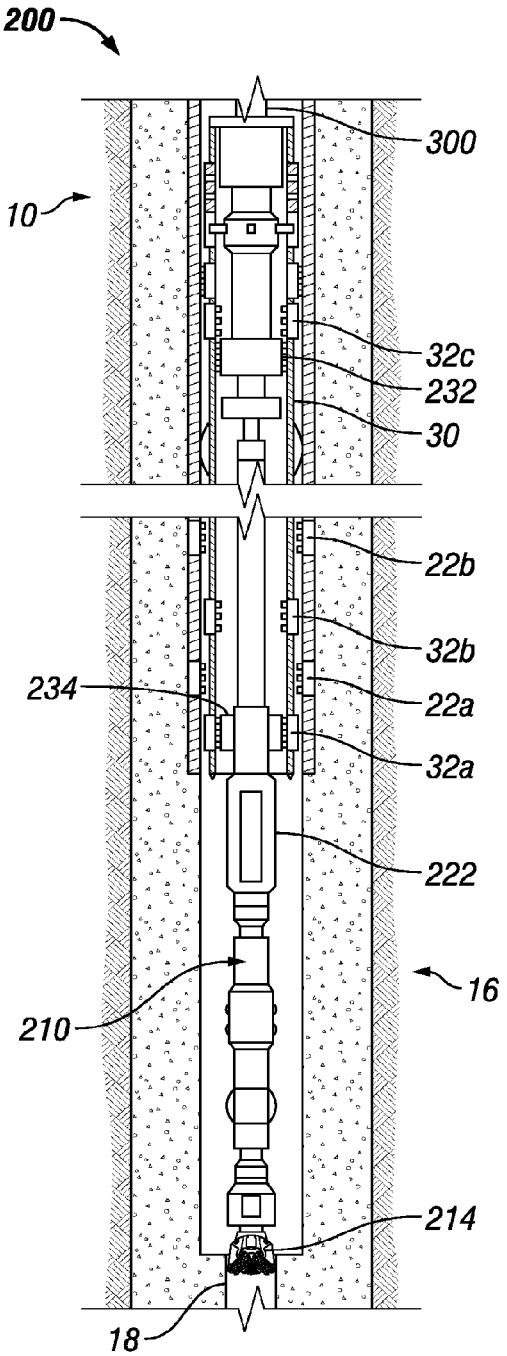
FIGS. 8-12 are axial cross sections of the well and the lining member while directional drilling system of FIG. 7, illustrating intermediate change out of a bottom hole assembly while parking the conveyed lining member according to the method of FIG. 2.

According to decision step 118, if directional drilling BHA 210 requires retrieval at any point prior to reaching total depth, upper reamer 222 may be deactivated, as annotated in step 120 of FIG. 2 and illustrated in FIG. 8.

Figure 9:
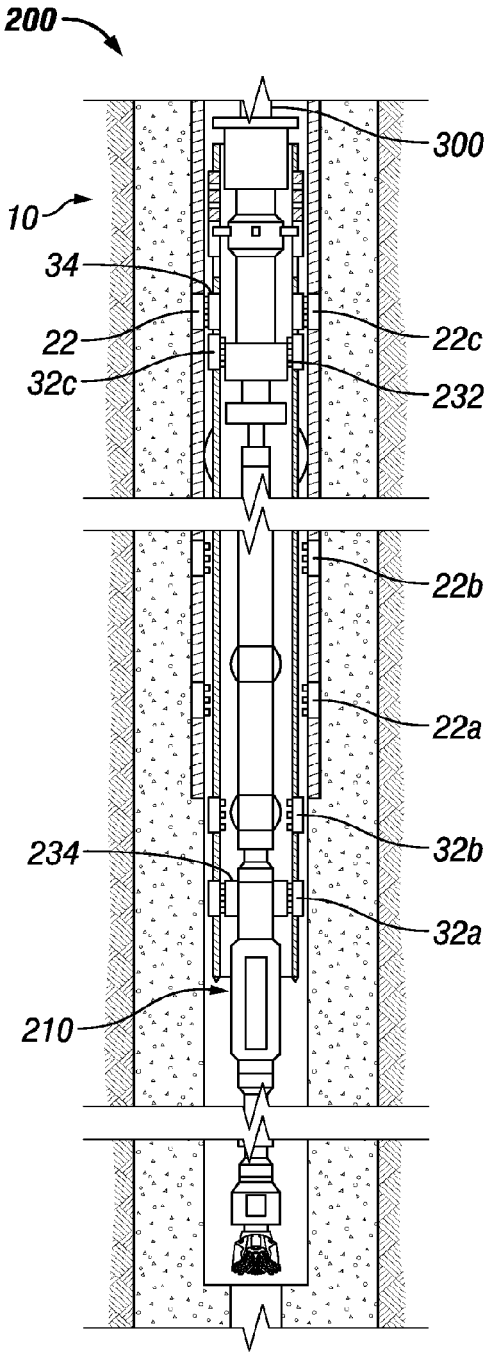

Continuing with step 120 of FIG. 2 and referring to FIG. 9, lining member 30, with directional drilling BHA 210, may be moved by drilling running tool 300 to the nearest interior casing latch coupling 22, which may be an upper or the uppermost interior casing latch coupling 22*c*, as illustrated. There, lining member 30 may be temporarily parked, using the matched exterior liner latch assembly 34 and parent casing 20 interior latch coupling 22.

Figure 10:
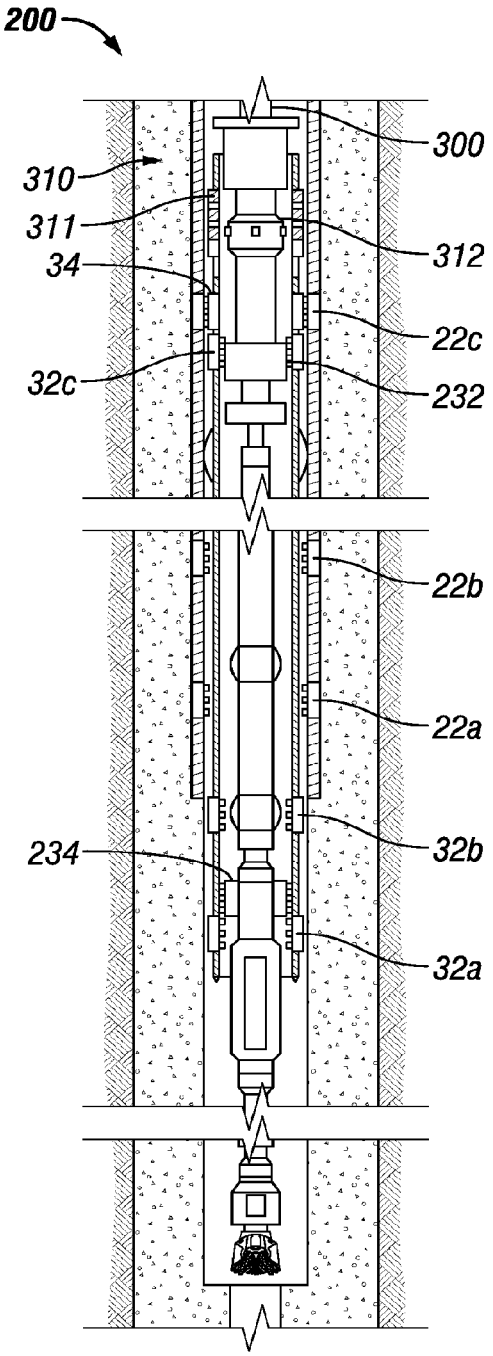
Figure 11:
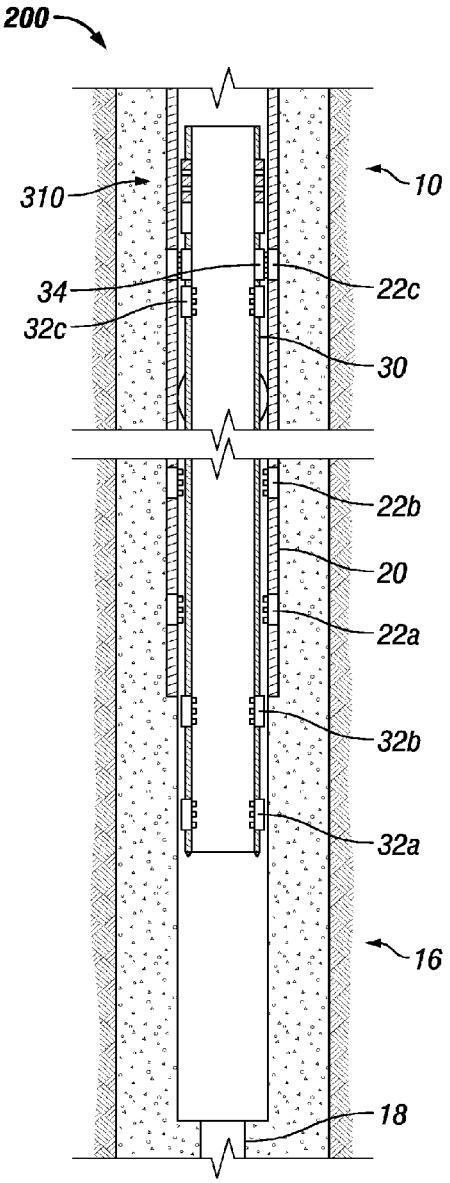

Afterwards, as noted in step 120 of FIG. 2 and illustrated in FIG. 10, directional drilling BHA 210 may be released from lining member 30 by disengaging collet assembly 312 from body 311 of liner hanger 310 and by unlatching lower inner string latch assembly 234 from liner latch coupling 32*a*. Thereafter, according to step 120 of FIG. 2 and shown in FIG. 11, directional drilling BHA 210 may be tripped out to the surface using running tool 300.

Figure 12:
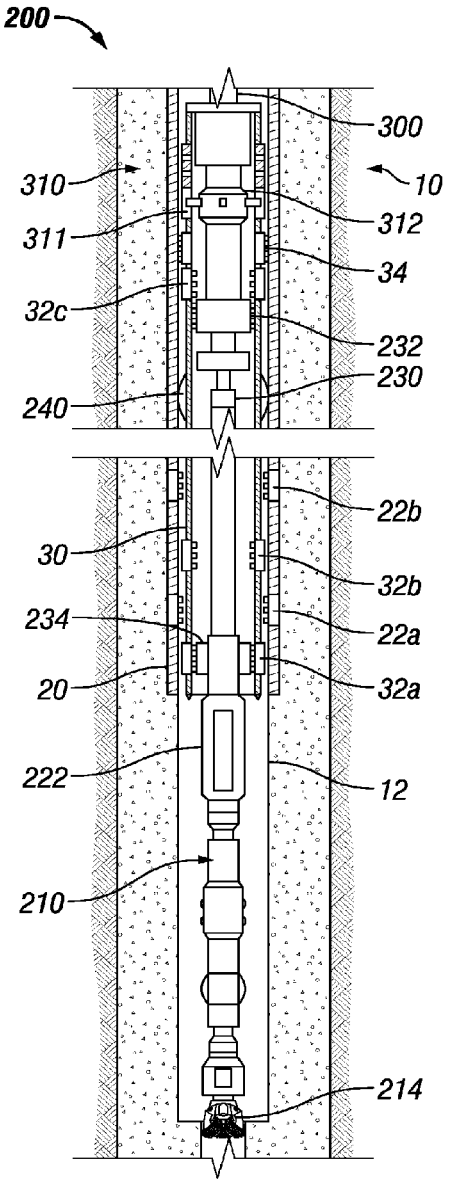

At step 122 of FIG. 2, changes to directional drilling BHA 210 may be made at the surface, as required. Directional drilling BHA 210 may then be run into wellbore 12 via running tool 300, and collet assembly 312 of liner hanger 310 may be engaged with liner hanger body 311, as illustrated in FIG. 12. Thereafter, pumping through the inner string may be commenced to extend telescopic joint 230 to engage/anchor lower latch assembly 234 with lower liner latch coupling 32*a*. Finally, external liner latch assembly 34 may be unlatched from casing latching coupling 22*c* to unpark lining member 30 from casing 20.

Figure 13:
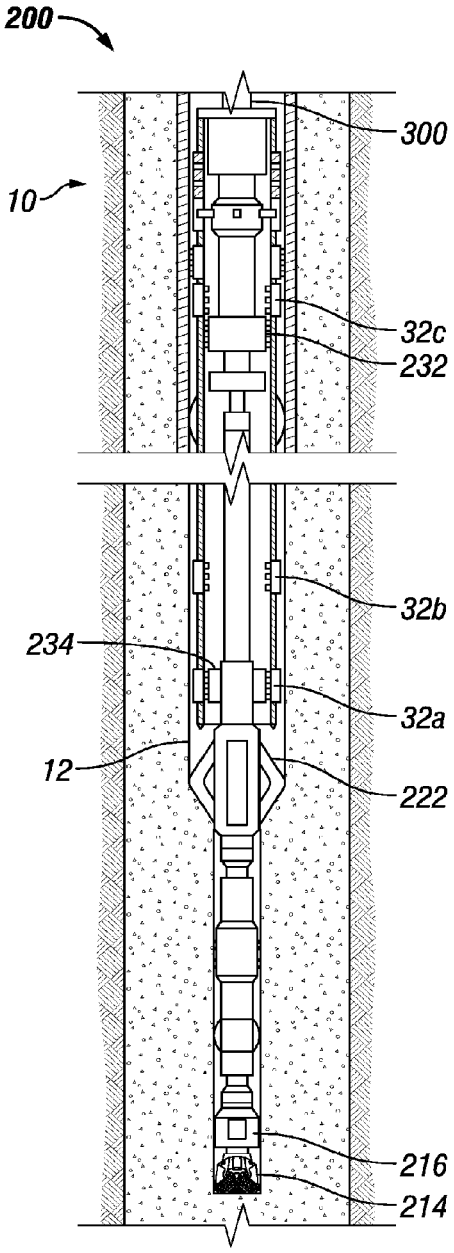
FIG. 13 is an axial cross section of the well and liner while directional drilling system of FIG. 12, illustrating resumed directional drilling operations while conveying a lining member after swapping a bottom hole assembly according to the method of FIG. 2.

FIG. 13 is a an axial cross section of well 10 with liner while drilling system 200 according to directional drilling step 124 of FIG. 2. Referring to FIGS. 2 and 13, directional drilling BHA 210 may be run to the bottom of wellbore 12, upper reamer 222 may be activated, and drilling may be resumed. Until total depth is reached, steps 118 through 124 may be repeated as necessary.

Figure 14:
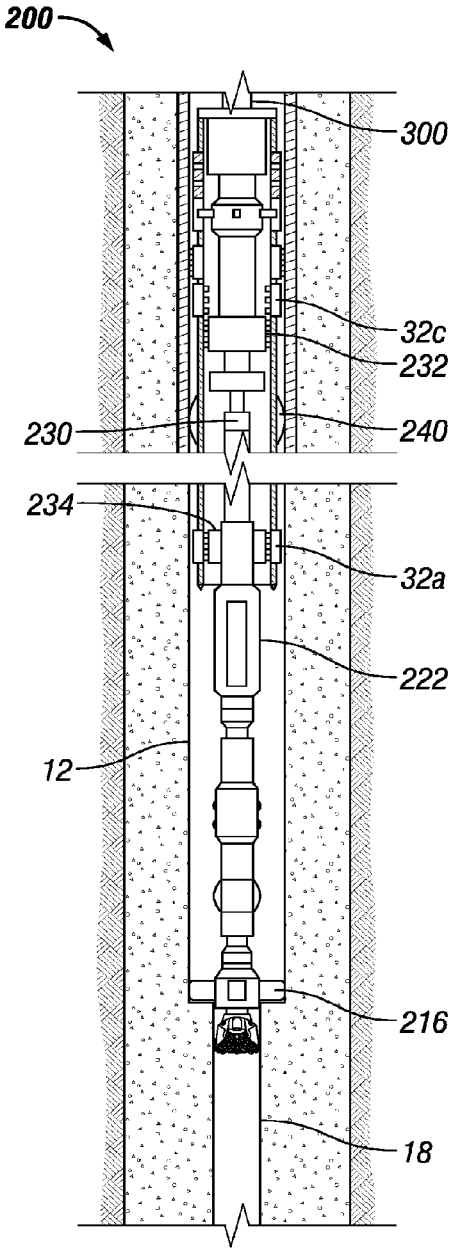
FIGS. 14-17 are axial cross sections of the well and the liner while directional drilling system of FIG. 13, illustrating a method for total depth reaming and parking the conveyed lining member according to an embodiment.
Figure 15:
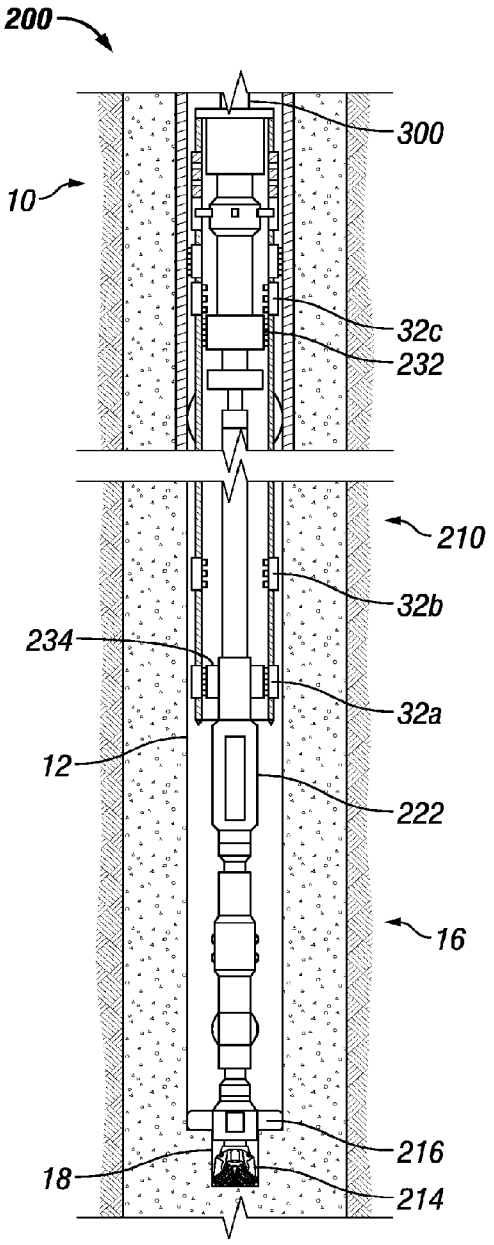

When total depth is reached, steps 126, 128, and 130 of FIG. 2 may be performed to enlarge pilot hole 18 and hang lining member 30 at the lowermost interior casing latch coupling 22. In one or more embodiments, running tool 300 may be used to raise directional drilling BHA 210 out of pilot hole 18, as follows. Referring to FIGS. 2 and 14, upper reamer 222 may be deactivated. Then, directional drilling BHA 210, carrying lining member 30, may be pulled by running tool 300 until total depth reamer 216 and drill bit 214 are positioned above pilot hole 18. Total depth reamer 216 may then be activated. Referring to FIG. 15, directional drilling BHA 210, with lining member 30, may be lowered via running tool 300 to enlarge pilot hole 18 to the point where drill bit contacts the bottom of pilot hole 12. Total depth reamer 216 may then be deactivated.

Figure 16:
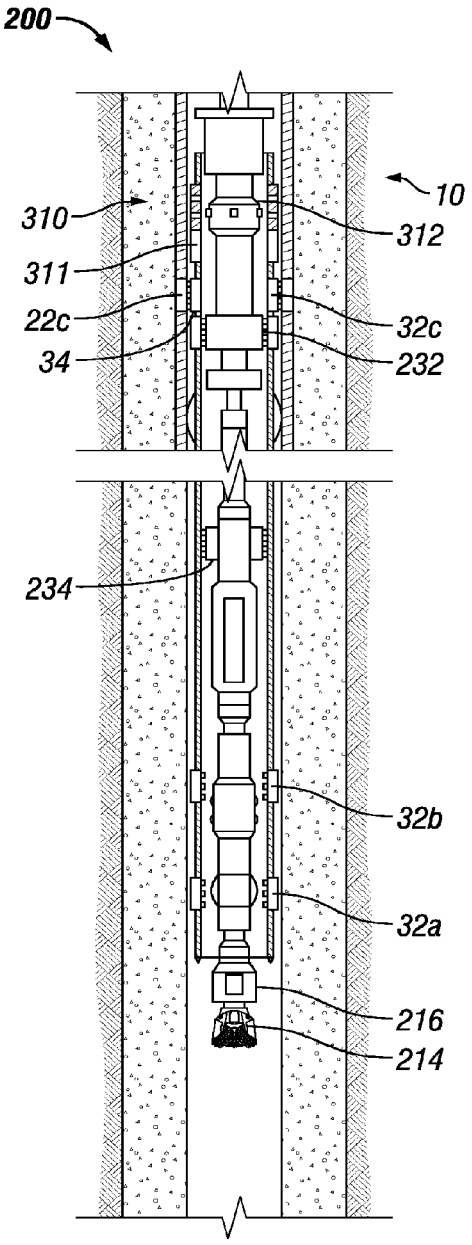

FIG. 16 is a an axial cross section of well 10 with liner while drilling system 200 illustrating repositioning step 128 of FIG. 2. Referring to FIGS. 2 and 16, total depth reamer 216 is in a deactivated state. Lining member 30, with directional drilling BHA 210, may be moved by drilling running tool 300 to the nearest interior casing latch coupling 22, which may be an upper or the uppermost interior casing latch coupling 22*b*, 22*c* in casing 20. There, lining member 30 may be temporarily parked, using the matched exterior liner latch assembly 34 and parent casing 20 interior latch coupling 22. Afterwards, directional drilling BHA 210 may be released from lining member 30 by disengaging collet assembly 312 from body 311 of liner hanger 310 and by unlatching lower inner string latch assembly 234 from liner latch coupling 32. Thereafter, directional drilling BHA 210 may be raised to position and latch upper inner string external latch assembly 232 at the uppermost interior liner latch coupling 32*c* so that most of directional drilling BHA 210 is located within lining member 30.

Figure 17:
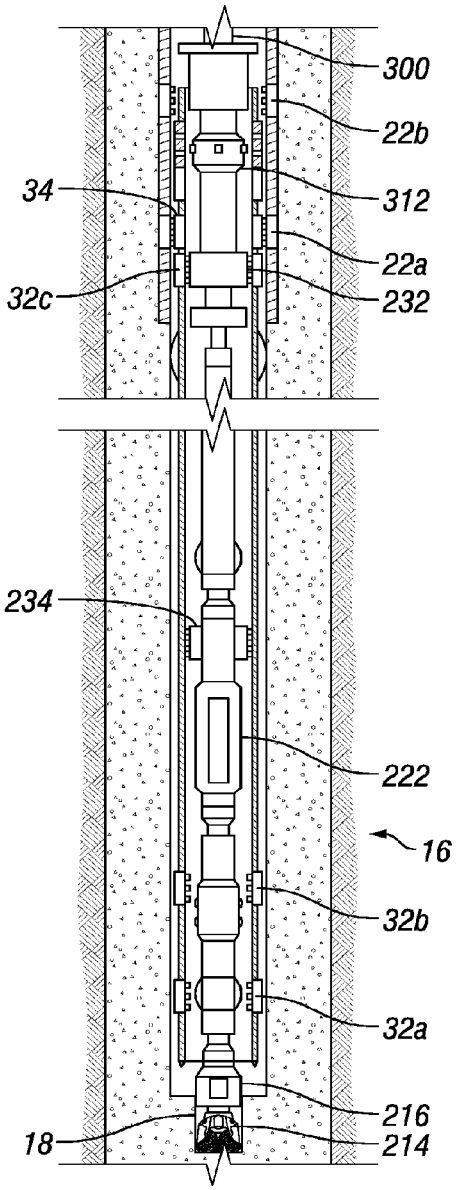

As shown in FIG. 17, at step 130 of FIG. 2, running tool 300 may then be lowered to lower lining member 30 into lower portion 16 of wellbore 12. Lining member 30 may be manipulated so that exterior liner latch assembly 34 is positioned and engages lowermost casing latch coupling 22*a*.

Figure 18:
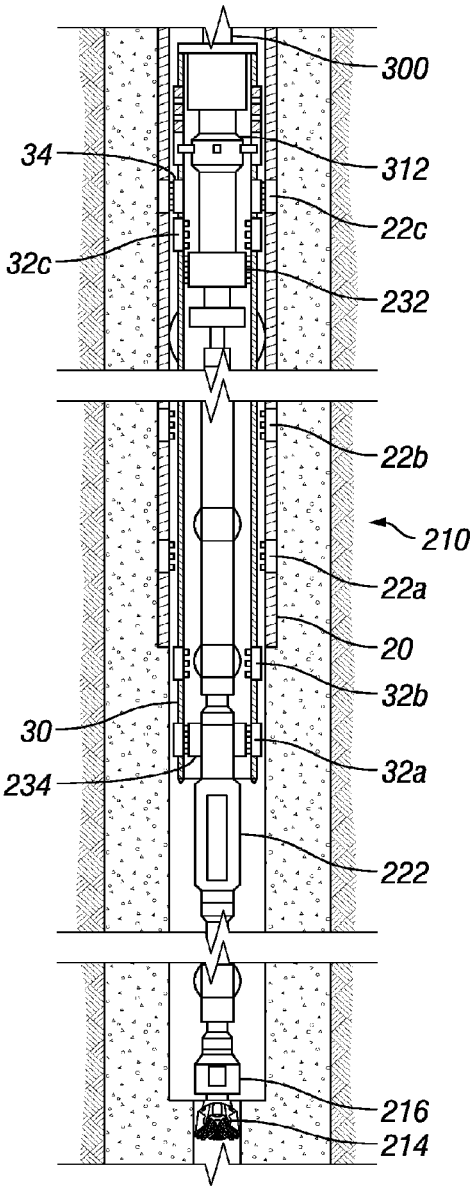
FIGS. 18-22 are axial cross sections of the well and the liner while directional drilling system of FIG. 13, illustrating a method for total depth reaming and parking the conveyed lining member according to an embodiment.
Figure 19:
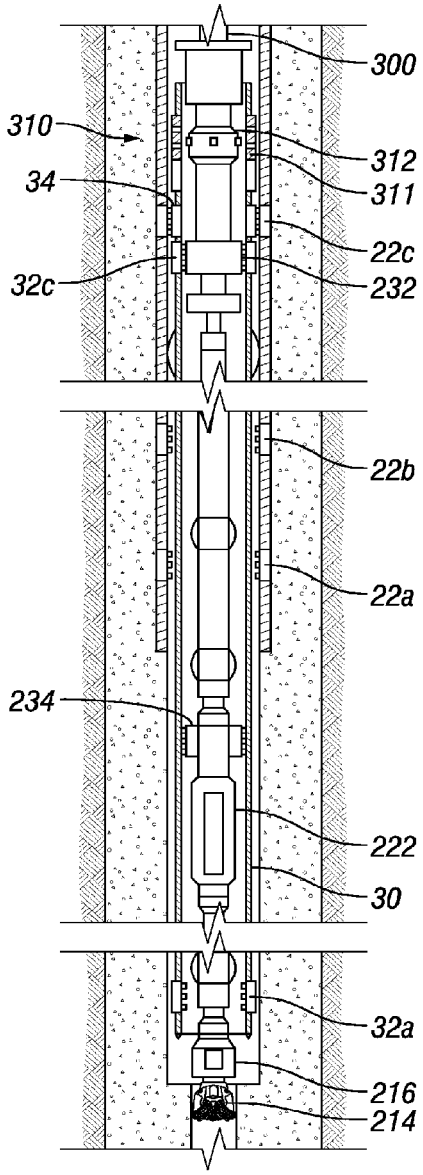

However, in one or more embodiments, steps 126 and 128 may be performed in a reverse order: Referring to FIGS. 2 and 18, directional drilling BHA 210 may first be repositioned within lining member 30 as follows. Upper reamer 222 may be deactivated. Directional drilling BHA 210 may be moved by drilling running tool 300 to align exterior liner latch assembly 34 with the nearest interior casing latch coupling 22, which may be an upper or the uppermost interior casing latch coupling 22*b*, 22*c* in casing 20. There, lining member 30 may be temporarily parked, using the matched exterior liner latch assembly 34 and parent casing 20 interior latch coupling 22. Afterwards, as shown in FIG. 19, directional drilling BHA 210 may be released from lining member 30 by disengaging collet assembly 312 from body 311 of liner hanger 310 and by unlatching lower inner string latch assembly 234 from liner latch coupling 32*a*. Thereafter, directional drilling BHA 210 may be raised to position and latch upper inner string external latch assembly 232 at the uppermost interior liner latch coupling 32*c* so that most of directional drilling BHA 210, except for total depth reamer 216 and drill bit 218, is located within lining member 30.

Figure 20:
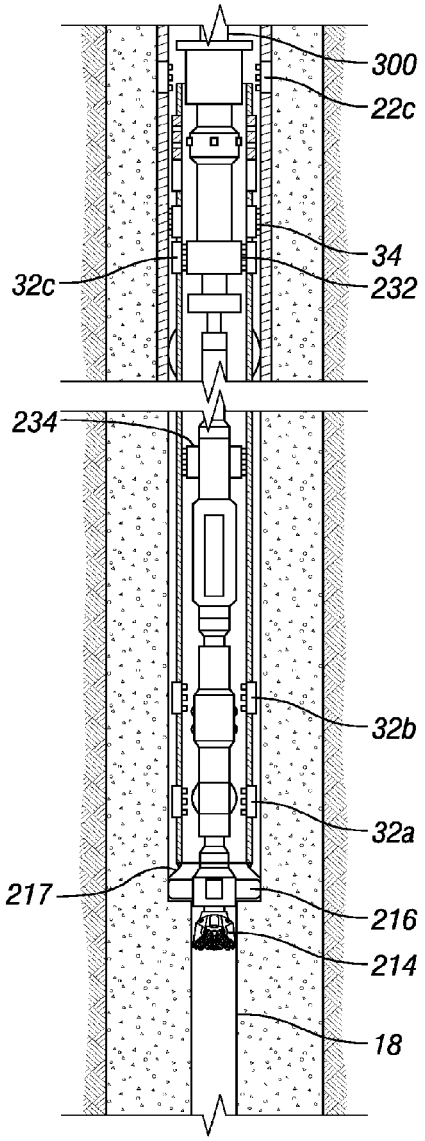
Figure 21:
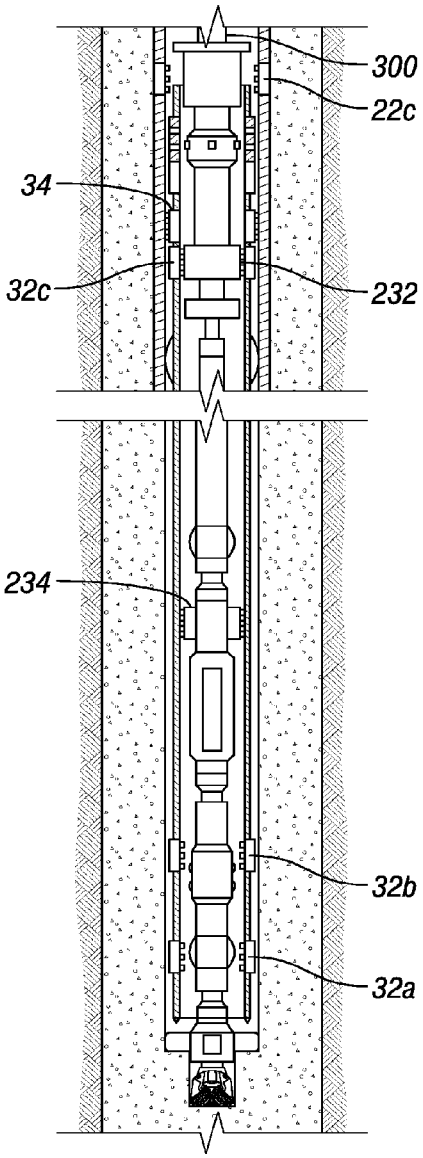

Referring to FIG. 20, external liner latch assembly 34 may next be disengaged from interior casing latch 22, and running tool 300 may be used to raise total depth reamer 216 out of pilot hole 18, if necessary. Total depth reamer 216 may then be activated. Then, as shown in FIG. 21, directional drilling BHA 210, carrying lining member 30, may be lowered by running tool 300 to enlarge pilot hole 18 to the point where drill bit contacts the bottom of pilot hole 12. The inner string upper latch assembly 232 and liner latch coupling 32*c* will handle the weight and transmit torque to lining member 30.

FIG. 20 also illustrates an option that includes a liner shoe reamer 217 located at the bottom end of lining member 30. With drill bit 214 located in pilot hole 18 and acting as a guide, lining member 30 may be rotated by running tool 300 to rotate liner shoe reamer 217 to enlarge pilot hole 18. Liner shoe reamer 217 may be used in addition to or in place of total depth reamer 216.

Figure 22:
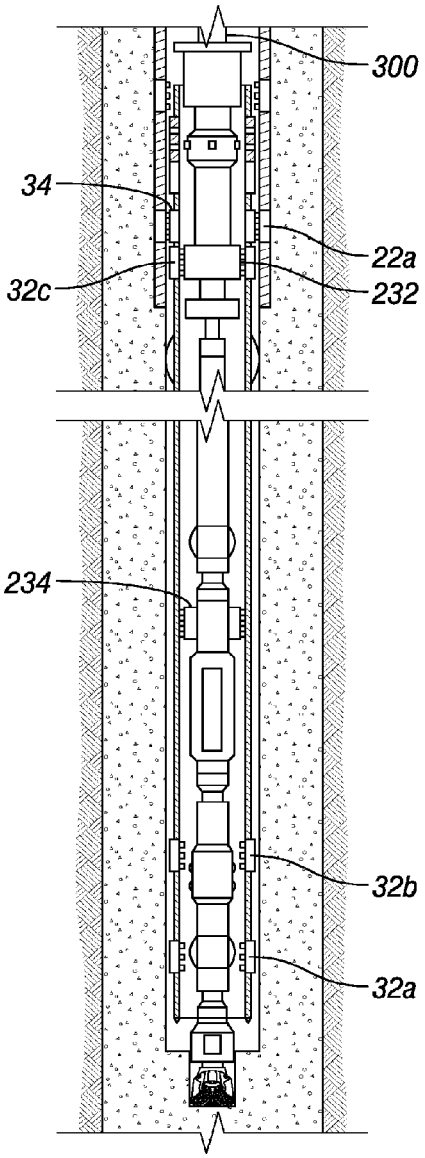

As shown in FIG. 22, at the completion of hole enlargement, total depth reamer 216 may be deactivated. Running tool 300 may be raised and/or otherwise manipulated to align and connect exterior liner latch assembly 34 with lowermost casing latch coupling 22*a* for parking lining member 30.

Figure 23:
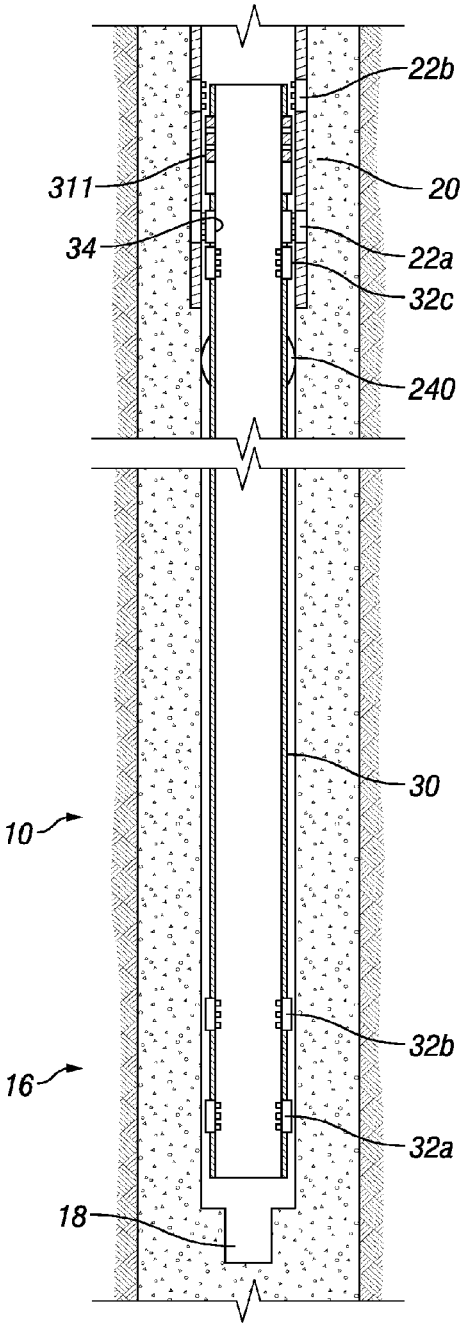
FIG. 23 is an axial cross section of the well of FIG. 13, having been reamed to total depth according to the method of FIG. 2.

Regardless of the order of performance steps 126 and 128 of FIG. 2, at step 130, directional drilling BHA 210 may be unlatched from lining member 30 by unlatching upper latch assembly 232 from internal latch coupling 32*c*, and, as illustrated in FIG. 23, running tool and BHA 210 may be pulled out of hole.

Figure 24:
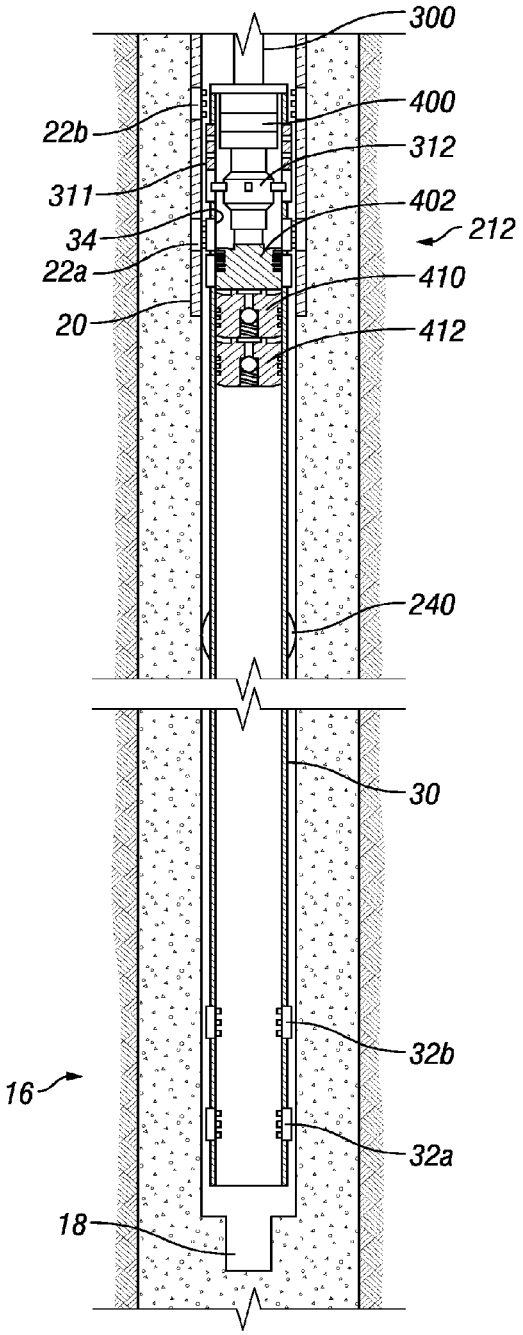
FIGS. 24-28 are axial cross sections of the well of FIG. 23 with an expansion/cementing running tool assembly according to an embodiment for cementing and expanding operations according to the method of FIG. 2.

Referring to FIGS. 2 and 24, at unlatching step 132 an expansion/cementing running tool assembly 212 having float equipment may be run in hole. Expansion/cementing running tool assembly 212 may include an expansion tool 400, a cement displacement wiper plug 402, and upper and lower float plugs 410, 412. In an embodiment, the profile of the upper and lower float plugs 410, 412 may be such as to be accepted by the liner latch couplings 32*a*, 32*b*. Accordingly, incorporating latch couplings 32*a*, 32*b* at the lower end of lining member 30 may enhance the ability to perform a conventional liner cementation, as further described below.

Figure 25:
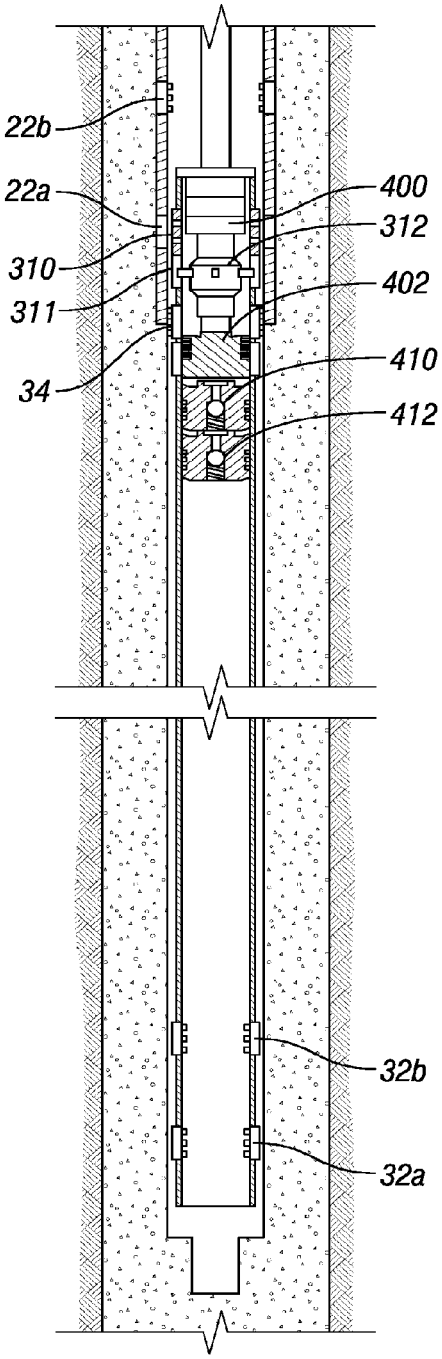

Collet assembly 312 may be engaged with liner hanger body 311, and as illustrated in FIG. 25, lining member 30 may be unlatched from casing 20 by unlatching exterior liner latch assembly 34 from interior casing latch coupling 22*a*. Circulation may be provided to remove borehole cuttings and clean wellbore 12.

Figure 26:
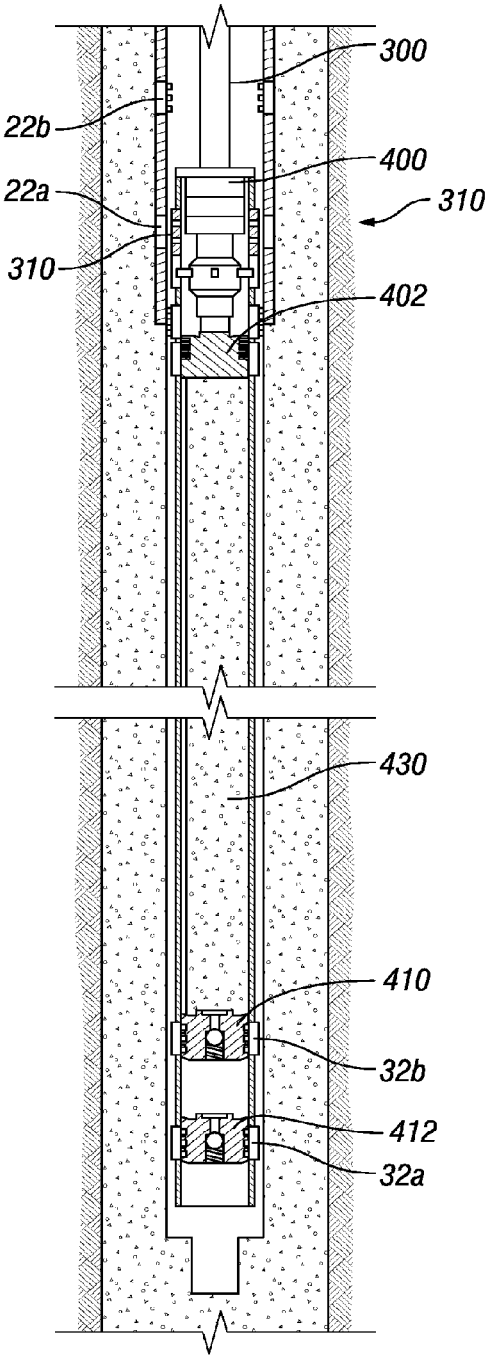

Referring to FIGS. 2 and 26, at step 134 a cementing operation may be performed as follows. A first drop ball/dart (not illustrated) may be flowed through expansion/cementing running tool assembly 212 to release lower float plug 412, which may land at lower liner latch coupling 32*a*. Similarly, a second drop ball/dart (not illustrated) may be flowed through expansion/cementing running tool assembly 212 to release upper float plug 410, which may land at the next liner latch coupling 32*b*. Dual plugs may serve as redundant back pressure valves and float shoes in a conventional cement process. The shoe track may avoid cement contamination in the annulus. After float plugs 410, 412 have landed at latch couplings 32*b*, 32*a*, respectively, cement 430 may be pumped through expansion/cementing running tool assembly 212.

Figure 27:
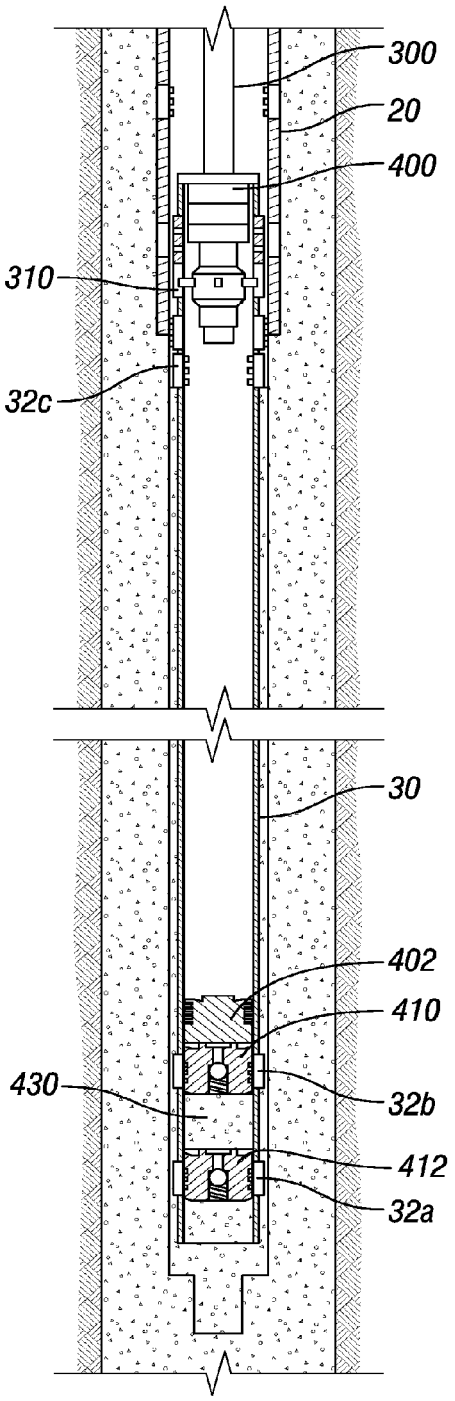

Next, as shown in FIG. 27, step 134 (FIG. 2) may continue by dropping a ball/dart (not illustrated) to release cement displacement wiper plug 402. Cement pumping may continue, displacing cement displacement wiper plug 402 downhole until cement displacement wiper plug 402 bumps and lands atop upper float valve 410.

Figure 28:
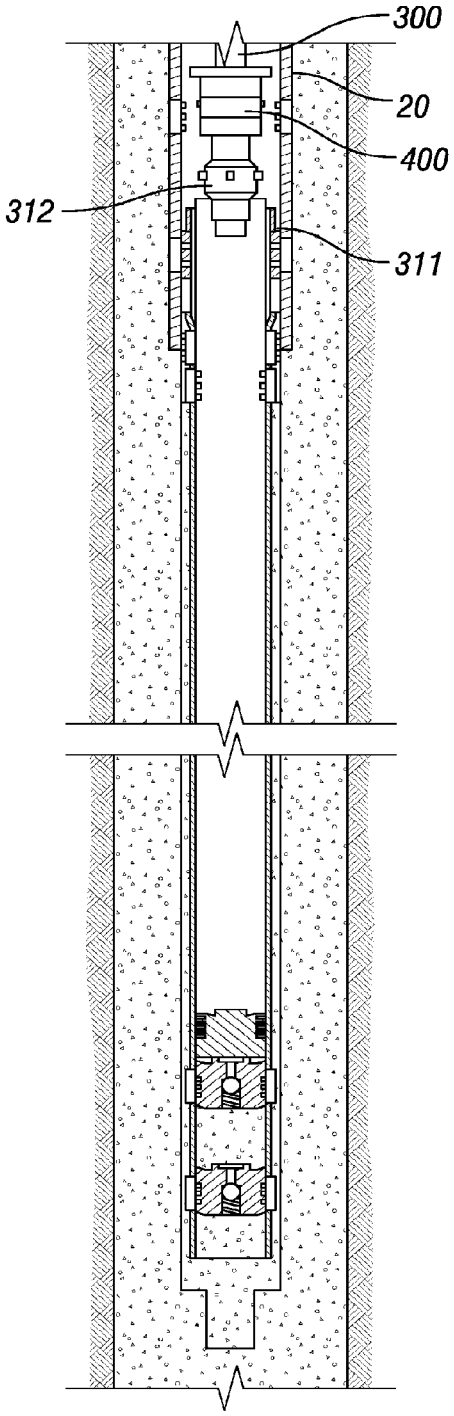

Referring to FIGS. 2 and 28, at expansion step 136, liner hanger 310, which in an embodiment may be a Halliburton VersaFlex® liner hanger, may be expanded hydraulically by dropping a ball, using expansion tool 400. Collet assembly 312 may then be disengaged and lifted. Circulation to clean wellbore 12 may be performed, and expansion tool 400 may be pulled out of hole using running tool 300.

In summary, a method for forming a wellbore and a liner running system have been described. Embodiments of the method for forming a wellbore may generally include: installing a casing in an upper portion of a wellbore, the casing having upper and lower interior casing latch coupling; providing a bottom hole assembly having upper and lower exterior inner string latch assemblies; disposing the bottom hole assembly through a lining member, the lining member having a upper and lower interior liner latch couplings each dimensioned for connection to the upper and lower exterior inner string latch assemblies and an exterior liner latch assembly dimensioned for connection to the upper and lower interior casing latch couplings; connecting the bottom hole assembly to a running tool; connecting the exterior inner string latch assembly to the lower interior liner latch coupling, with at least a lower portion of the bottom hole assembly extending beyond a lower edge of the lining member; and lowering the bottom hole assembly with the lining member into the casing by the running tool. Embodiments of the liner running system may generally have: a bottom hole assembly having upper and lower exterior inner string latch assemblies; and a lining member having a upper and lower interior liner latch couplings each dimensioned for connection to the upper and lower exterior inner string latch assemblies and an exterior liner latch assembly dimensioned for connection to upper and lower interior casing latch couplings; whereby the bottom hole assembly is adapted to selectively carry the lining member via the exterior inner string latch assembly and the lower interior liner latch coupling.

Any of the foregoing embodiments may include any one of the following elements or characteristics, alone or in combination with each other: the bottom hole assembly is a directional drilling bottom hole assembly; directionally drilling a lower portion of the wellbore along a well trajectory using a drill bit and a steerable system of the directional drilling bottom hole assembly; the lower portion of the bottom hole assembly extending beyond the lower edge of the lining member includes a reamer; drilling a pilot hole of lower portion of the wellbore using the drill bit; reaming the pilot hole below the casing using the reamer; hanging the lining member by the exterior liner latch assembly from one of the upper and lower interior casing latch couplings; disconnecting the lower exterior inner string latch assembly from the lower interior liner latch coupling; removing the bottom hole assembly from the wellbore; reinserting the bottom hole assembly into the wellbore; connecting the lower exterior inner string latch assembly to the lower interior liner latch coupling; disconnecting the exterior liner latch assembly from the one of the upper and lower interior casing latch coupling; reaming a pilot hole to a near total depth by a total depth reamer of the bottom hole assembly; raising the bottom hole assembly and the lining member; hanging the lining member by the exterior liner latch assembly from the upper interior casing latch coupling; disconnecting the lower exterior inner string latch assembly from the lower interior liner latch coupling; raising the bottom hole assembly within the lining member; connecting the one of the upper and lower exterior inner string latch assemblies to the upper interior liner latch coupling so that a substantial portion of the bottom hole assembly is disposed within the lining member; lowering the bottom hole assembly and the lining member; hanging the lining member by the exterior liner latch assembly from the lower interior casing latch coupling; disconnecting the lower exterior inner string latch assembly from the upper interior liner latch coupling; removing the bottom hole assembly from the wellbore; providing a liner hanger having a hanger body and a collet assembly, the hanger body connected to the lining member, the collet assembly connected between the bottom hole assembly and the running tool; transmitting torque and axial force by the collet assembly between the running tool and the bottom hole assembly; providing a telescopic joint within the bottom hole assembly; selectively engaging the collet assembly with the hanger body; selectively extending the telescopic joint to connect the exterior inner string latch assembly to the lower interior liner latch coupling; the bottom hole assembly is an expansion/cementing running tool assembly having an expansion tool, and displacement wiper plug, and a float plug; engaging the collet assembly to the hanger body, flowing a first drop ball/dart through the expansion/cementing running tool assembly to release the float plug; landing the float plug at the lower interior liner latch coupling; pumping cement through the expansion/cementing running tool into the wellbore; flowing a second drop ball/dart through the expansion/cementing running tool assembly to release the wiper plug; displacing the wiper plug downhole until the wiper plug lands on the float plug; expanding the expansion tool; disengaging the collet assembly from the hanger body; removing the collet assembly from the wellbore by the running tool; the bottom hole assembly is a clean-out bottom hole assembly; cleaning the wellbore with the clean-out bottom hole assembly; the bottom hole assembly is a steerable directional drilling bottom hole assembly including a drill bit, a reamer, a motor, and a measurement while drilling sub; the bottom hole assembly includes a total depth reamer disposed adjacent the drill bit; the motor and the measurement while drilling sub are selectively disposed within the lining member; a liner hanger having a hanger body and a collet assembly, the hanger body connected to the lining member, the collet assembly connected between the bottom hole assembly and the running tool; a telescopic joint disposed within the bottom hole assembly between the collet assembly and the lower exterior inner string latch assembly; the bottom hole assembly is an expansion/cementing running tool assembly having an expansion tool, and displacement wiper plug, and a float plug, the float plug dimensioned for connection to the lower exterior inner string latch assembly; first and second lower interior liner latch couplings located within the interior of the lining member; first and second float plugs dimensioned for connection to the first and second lower exterior inner string latch assemblies, respectively; and the bottom hole assembly is a clean-out bottom hole assembly.

The Abstract of the disclosure is solely for providing the a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A method for forming a wellbore, comprising:

installing a casing in an upper portion of a wellbore, said casing having upper and lower interior casing latch couplings;

providing a bottom hole assembly having upper and lower exterior latch assemblies;

disposing said bottom hole assembly through a lining member, said lining member having upper and lower interior liner latch couplings each dimensioned for connection to said upper and lower exterior latch assemblies of the bottom hole assembly and an exterior liner latch assembly dimensioned for connection to each of said upper and lower interior casing latch couplings;

connecting said bottom hole assembly to a running tool with a liner hanger having a hanger body and a collet assembly, such that said hanger body is connected to said lining member and said collet assembly is connected between said bottom hole assembly and said running tool;

connecting said lower exterior latch assembly of the bottom hole assembly to said lower interior liner latch coupling, with at least a lower portion of said bottom hole assembly extending beyond a lower edge of said lining member;

lowering said bottom hole assembly with said lining member into said casing by said running tool;

releasing a float plug from said bottom hole assembly;

landing said float plug at said lower interior liner latch coupling; and disengaging said collet assembly from said hanger body.

2. The method of claim 1, wherein:

said bottom hole assembly is a directional drilling bottom hole assembly; and the method further comprises directionally drilling a lower portion of said wellbore along a well trajectory using a drill bit and a steerable system of said directional drilling bottom hole assembly.

3. The method of claim 2, wherein:

said lower portion of said bottom hole assembly extending beyond said lower edge of said lining member includes a reamer; and the method further comprises, drilling a pilot hole of lower portion of said wellbore using said drill bit; and reaming said pilot hole below said casing using said reamer.

4. The method of claim 1, further comprising:

hanging said lining member by said exterior liner latch assembly from one of said upper and lower interior casing latch couplings;

disconnecting said lower exterior latch assembly of the bottom hole assembly from said lower interior liner latch coupling; and then removing said bottom hole assembly from said wellbore.

5. The method of claim 4, further comprising:

reinserting said bottom hole assembly into said wellbore;

connecting said lower exterior latch assembly of the bottom hole assembly to said lower interior liner latch coupling; and then disconnecting said exterior liner latch assembly from said one of said upper and lower interior casing latch coupling.

6. The method of claim 1, further comprising:

reaming a pilot hole to a near total depth by a total depth reamer of said bottom hole assembly;

raising said bottom hole assembly and said lining member;

hanging said lining member by said exterior liner latch assembly from said upper interior casing latch coupling;

disconnecting said lower exterior latch assembly of the bottom hole assembly from said lower interior liner latch coupling;

raising said bottom hole assembly within said lining member;

connecting said one of said upper and lower exterior latch assemblies of the bottom hole assembly to said upper interior liner latch coupling so that a substantial portion of the bottom hole assembly is disposed within said lining member;

lowering said bottom hole assembly and said lining member;

hanging said lining member by said exterior liner latch assembly from said lower interior casing latch coupling;

disconnecting said lower exterior latch assembly of the bottom hole assembly from said upper interior liner latch coupling; and removing said bottom hole assembly from said wellbore.

7. The method of claim 1, wherein:

said bottom hole assembly is a clean-out bottom hole assembly; and the method further comprises cleaning said wellbore with said clean-out bottom hole assembly.

8. The method of claim 1, further comprising:

transmitting torque and axial force by said collet assembly between said running tool and said bottom hole assembly.

9. The method of claim 1, further comprising:

providing a telescopic joint within said bottom hole assembly;

selectively engaging said collet assembly with said hanger body; and selectively extending said telescopic joint to connect said lower exterior latch assembly of the bottom hole assembly to said lower interior liner latch coupling.

10. The method of claim 1, wherein:

said bottom hole assembly is an expansion/cementing running tool assembly having an expansion tool, a displacement wiper plug, and the float plug; and the method further comprises, flowing a first drop ball/dart through said expansion/cementing running tool assembly to release said float plug;

pumping cement through said expansion/cementing running assembly tool into said wellbore;

flowing a second drop ball/dart through said expansion/cementing running tool assembly to release said wiper plug;

displacing said wiper plug downhole until said wiper plug lands on said float plug;

expanding said expansion tool, and removing said collet assembly from said wellbore by said running tool.

11. A liner running system, comprising:

a bottom hole assembly having upper and lower exterior latch assemblies, a displacement wiper plug, and a first float plug, said first float plug dimensioned for connection to said lower exterior latch assembly of the bottom hole assembly;

a lining member having upper and lower interior liner latch couplings each dimensioned for connection to said upper and lower exterior latch assemblies of the bottom hole assembly and an exterior liner latch assembly dimensioned for connection to each of upper and lower interior casing latch couplings; whereby said bottom hole assembly is adapted to selectively carry said lining member via said exterior latch assemblies and said lower interior liner latch coupling;

the first float plug dimensioned for connection to said lower interior liner latch coupling.

12. The system of claim 11, wherein:

said bottom hole assembly is a steerable directional drilling bottom hole assembly including a drill bit, a reamer, a motor, and a measurement while drilling sub.

13. The system of claim 12, wherein:

said bottom hole assembly includes a total depth reamer disposed adjacent said drill bit.

14. The system of claim 12, wherein:

said motor and said measurement while drilling sub are selectively disposed within said lining member.

15. The system of claim 11, further comprising:

a liner hanger having a hanger body and a collet assembly, said hanger body connected to said lining member, said collet assembly connected between said bottom hole assembly and said running tool.

16. The system of claim 15, further comprising:

a telescopic joint disposed within said bottom hole assembly between said collet assembly and said lower exterior latch assembly of the bottom hole assembly.

17. The system of claim 11, wherein:

said bottom hole assembly is an expansion/cementing running tool assembly having an expansion tool.

18. The system of claim 17, further comprising:

an additional interior liner latch coupling located within the interior of said lining member; and a second float plug dimensioned for connection to said additional interior liner latch coupling.

19. The system of claim 11, wherein:

said bottom hole assembly is a clean-out bottom hole assembly.

* * * * *